US010239179B2

(12) United States Patent
Toncelli

(10) Patent No.: US 10,239,179 B2
(45) Date of Patent: Mar. 26, 2019

(54) METHOD FOR SMOOTHING AND/OR POLISHING SLABS OF STONE OR STONE-LIKE MATERIAL

(71) Applicant: Luca Toncelli, Bassano del Grappa (IT)

(72) Inventor: Luca Toncelli, Bassano del Grappa (IT)

( * ) Notice: Subject to any disclaimer, the term of this patent is extended or adjusted under 35 U.S.C. 154(b) by 57 days.

(21) Appl. No.: 15/328,168

(22) PCT Filed: Jul. 22, 2015

(86) PCT No.: PCT/IB2015/055536
§ 371 (c)(1),
(2) Date: Jan. 23, 2017

(87) PCT Pub. No.: WO2016/012950
PCT Pub. Date: Jan. 28, 2016

(65) Prior Publication Data

US 2017/0216988 A1 Aug. 3, 2017

(30) Foreign Application Priority Data

Jul. 24, 2014 (IT) ..... TV2014A0111

(51) Int. Cl.
*B24B 7/22* (2006.01)
*B24B 41/047* (2006.01)
*B24B 7/06* (2006.01)

(52) U.S. Cl.
CPC ..... *B24B 7/22* (2013.01); *B24B 7/06* (2013.01); *B24B 41/047* (2013.01)

(58) Field of Classification Search
CPC .. B24B 7/22; B24B 7/224; B24B 7/06; B24B 41/047

(Continued)

(56) References Cited

U.S. PATENT DOCUMENTS 2,735,238 A * 2/1956 Heffley ..... B24B 7/244 451/260
4,914,870 A * 4/1990 Toncelli ..... B24B 7/22 125/27

(Continued)

FOREIGN PATENT DOCUMENTS

WO 2011064706 A1 6/2011

OTHER PUBLICATIONS

PCT International Search Report and Written Opinion dated Nov. 2, 2015 for Intl. App. No. PCT/IB2015/055536, from which the instant application is based, 7 pgs.

(Continued)

*Primary Examiner* — George B Nguyen
(74) *Attorney, Agent, or Firm* — Fredrikson & Byron, P.A.

(57) ABSTRACT

A method for smoothing and/or polishing slabs of stone or stone-like material suitable for being implemented with a machine comprising: a support bench (16) for a slab to be machined; and at least one machining station (14). The machining station comprises two bridge support structures (20, 22) arranged transversely astride the support bench (16). A spindle-carrying beam (24), in suitable for being moved above the bridge structures in a transverse direction, is provided on the bridge support structures (20, 22). At least one spindle-carrying structure (34), suitable for being rotated about its own vertical axis (32), is provided on the spindle-carrying beam (24). Each spindle-carrying structure (34) is provided with two motorized spindles (38A, 38B), the ends of which are provided with machining heads (42A, 42B) arranged spaced apart and opposite each other with respect to the vertical axis (32) of the spindle-carrying structure (34) and comprising machining tools (44A, 44B). The machine comprises a programmable computerized unit for controlling the position, movement and speed of the moving members. The method is characterized in that: —the (Continued)

beam and the spindle-carrying structures move coordinated and synchronized with each other; —for each stroke of the beam (24) in the transverse direction, each spindle-carrying structure performs a rotation of 180° about its axis of rotation (32); —when the beam (24) is located at the center line of the bench (16), the axis (60) connecting the rotation axes of the spindles (38A, 38B) is perpendicular to the longitudinal direction of the machine; and —when the beam (24) is located at the maximum distance from the center line of the bench (16), the axis (60) is parallel to the longitudinal axis of the machine.

12 Claims, 7 Drawing Sheets

(58) Field of Classification Search
USPC ... 451/11, 41, 119, 121, 131, 132, 135, 150, 451/260
See application file for complete search history.

(56) References Cited

U.S. PATENT DOCUMENTS 5,056,272 A * 10/1991 Battaglia ..... B24B 7/06 125/13.01
6,645,043 B1 * 11/2003 Yenawine ..... B24B 7/242 451/11
7,351,130 B1 * 4/2008 Chang ..... B24B 7/06 451/11
7,632,171 B2 * 12/2009 Heesemann ..... B24B 7/06 451/190
9,238,291 B2 1/2016 Toncelli
2003/0092359 A1 * 5/2003 Pedrini ..... B24B 7/224 451/5
2005/0164614 A1 * 7/2005 Bau ..... B24B 7/06 451/296
2007/0082586 A1 * 4/2007 Ferrari ..... B24B 7/00 451/28
2007/0099546 A1 * 5/2007 Jespersen ..... B24B 7/06 451/11
2009/0163124 A1 * 6/2009 Chang ..... B24B 7/06 451/130
2013/0137346 A1 * 5/2013 Toncelli ..... B24B 7/06 451/150

OTHER PUBLICATIONS

Search Report and Written Opinion dated Oct. 20, 2014 for related Italian Application No. TV20140111, 6 pgs.

* cited by examiner

METHOD FOR SMOOTHING AND/OR POLISHING SLABS OF STONE OR STONE-LIKE MATERIAL

RELATED APPLICATIONS

This application is a 35 U.S.C. 371 national stage filing from International Application No. PCT/IB2015/055536, filed Jul. 22, 2015, which claims priority to Italian Application No. TV2014A000111, filed Jul. 24, 2014, the teachings of which are incorporated herein by reference.

The present invention relates to a method for smoothing and/or polishing slabs of stone or stone-like material.

The machines for carrying out this type of machining operation generally comprise a bench along which a conveyor belt for moving the slabs to be polished or smoothed travels, two bridge support structures arranged astride the conveyor belt, one in the vicinity of the entry point and the other in the vicinity of the exit for the slabs into/from the work zone.

A beam on which a plurality of vertical-axis smoothing and/or polishing spindles are mounted is provided between the two support structures.

Supports rotating about the vertical axis of the spindle and provided with abrasive tools are mounted at the bottom ends of the spindles.

The beam may be fixed or may move with a transverse alternating movement above the bench, depending on whether it manages to cover the entire working area or not.

In Italian patent application No. TV2009A000224 it is described a machine for smoothing and polishing slabs of stone material of this type. The particular feature of this machine is that it comprises a rotating spindle-carrying structure which is arranged on the beam and on which a plurality of spindles are arranged in eccentric positions with respect to the axis of rotation of the said structure.

In this type of machine, the tool-holder support is imparted a movement composed at least of:

- a rotation about the axis of rotation of the spindle;
- a revolving movement about the axis of rotation of the spindle-carrying structure;
- a translation movement in the transverse direction due to the alternating movement of the beam; and
- a translation movement in the longitudinal direction due to the advancing movement of the conveyor belt.

A machining head is also connected to each spindle, depending on the type of material and the type of machining which is to be performed.

Therefore the tool is provided with a further movement imparted by the machining head. For example, this movement may be a rotation of the tool about a vertical axis, in the case of a flat grinder head, or a rotation of the tool about a horizontal axis in the case of a roller head.

The actual path followed by the tool is therefore very complex and allows surfaces to be obtained which are smoothed or polished in a very uniform manner.

The combination of the movements creates an interlacing pattern of particularly complex and non-orderly paths producing various machining marks and a varying degrees of polishing (noticeable when viewing the slab against the light), these being not particularly visible to the naked eye, but in any case constituting an imperfection.

The object of the present invention is to solve the drawbacks of the prior art.

A first task is to provide a method for polishing or smoothing slabs of stone or stone-like material, as a result of which the machined slabs have even fewer imperfections compared to the slabs obtained with the methods of the prior art.

A second task of the present invention is to provide a particular machine configuration which allows optimum machining to be obtained.

Based on this machine, a particular polishing method has been developed, using a particular spindle-carrying structure and controlling the various movements in a predetermined manner which allows an optimum result to be achieved.

The object and tasks are obtained with a method for polishing or smoothing slabs of stone or stone-like material according to claim 1.

Further characteristic features of the present invention form the subject of the dependent claims.

The characteristic features and advantages of the present invention will emerge more clearly with reference to a number of examples of application, provided by way of non-limiting illustration, with reference the attached drawings in which.

Figure 1:
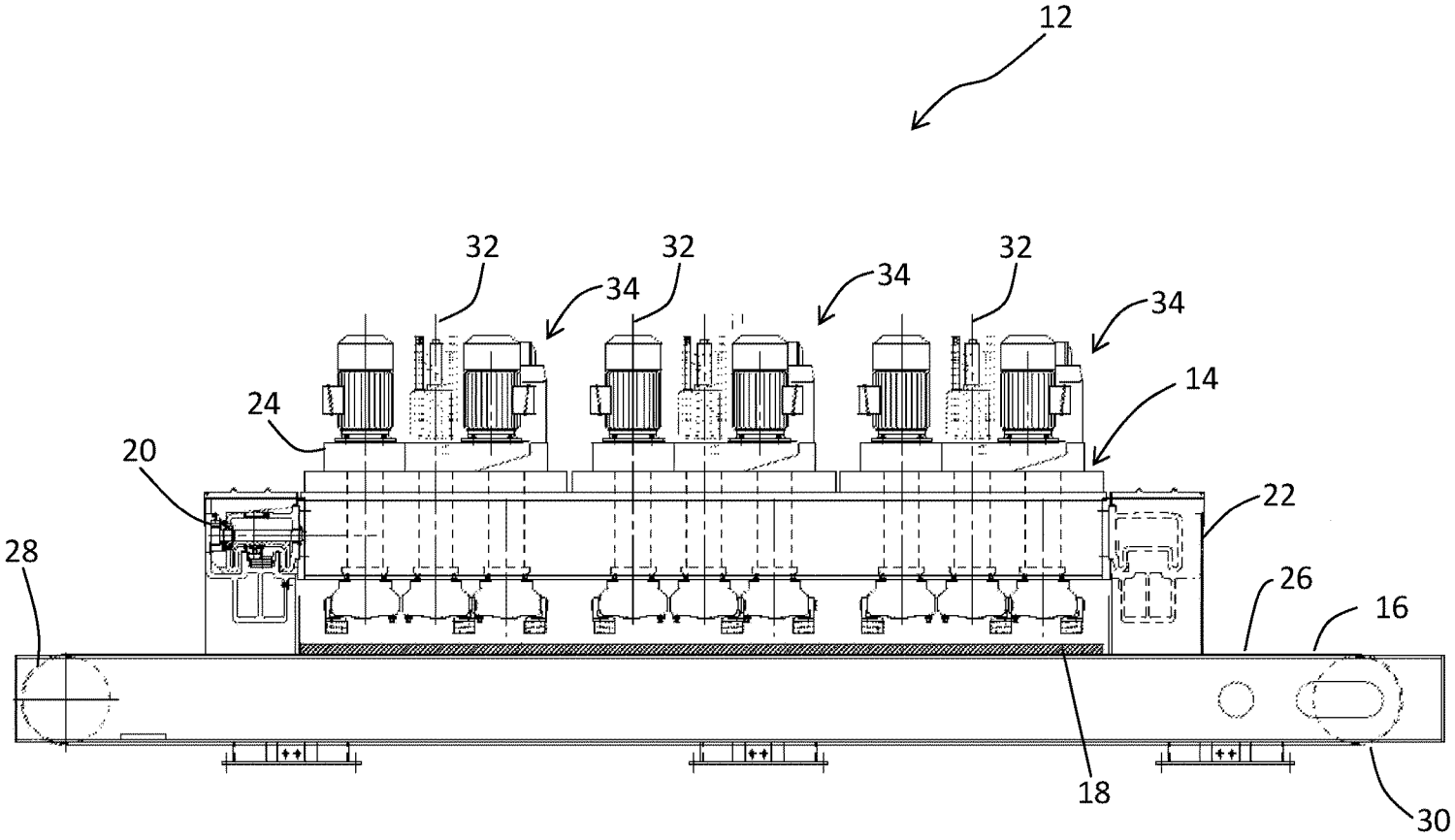
FIG. 1 shows a side view of a machine suitable for implementing the method according to the present invention.

In FIG. 1 the reference number 12 indicates a machine for polishing or smoothing slabs of stone or stone-like material.

The machine 12 comprises a machining station 14 which is arranged above a support surface or bench 16 for a slab 18 to be machined.

The machining station 14 comprises two bridge support structures 20, 22 transversely arranged astride the support surface 16, the first on the entry side for the material to be machined and the second on the exit side for the machined material. Entry and exit are understood as being in relation to the direction of relative movement of slab and station, as will be clarified below.

A spindle-carrying beam 24 is mounted on the two bridge structures 20, 22 and is therefore arranged in the longitudinal direction, parallel to the direction of relative movement of slab and station.

The spindle-carrying beam 24 is slidably supported on the bridge structures 20, 22 and can therefore be moved in a transverse direction which is perpendicular to the aforementioned longitudinal direction.

The beam 24 is moved along the two bridge structures with an alternating rectilinear movement by means of a suitable drive system, which is not shown in the figures, but may be easily imagined by the person skilled in the art.

In the longitudinal direction, parallel to the beam 24, the surface of the slab to be machined is imparted, owing to the motorized movement means, a relative translation movement with respect to the station 14 situated above.

In the preferred embodiment shown in the figures, it is the slab which is moved underneath the station, designed to be fixed. For this purpose, the movement means comprise a conveyor belt 26 mounted on the bench 16 and slidable for movement of the slabs to be polished or smoothed.

The belt 26 at the two ends of the bench 16 is wound around an idle roller 28 and a drive roller 30.

It is thus possible to perform continuous sequential feeding of slabs, as may be easily imagined by the person skilled in the art, so that there are no limits as regards the maximum length of the slabs.

Alternatively, the station 14 could also be designed so as to be displaced along the plane in the longitudinal direction, using movement means designed with a suitable motorized carriage.

At least one machining unit or spindle-carrying structure 34 is mounted on the movable beam 24 rotatably about an associated vertical axis 32. In the embodiment shown in FIG. 1, the beam 24 is provided with three spindle-carrying structures 34.

Figure 3:
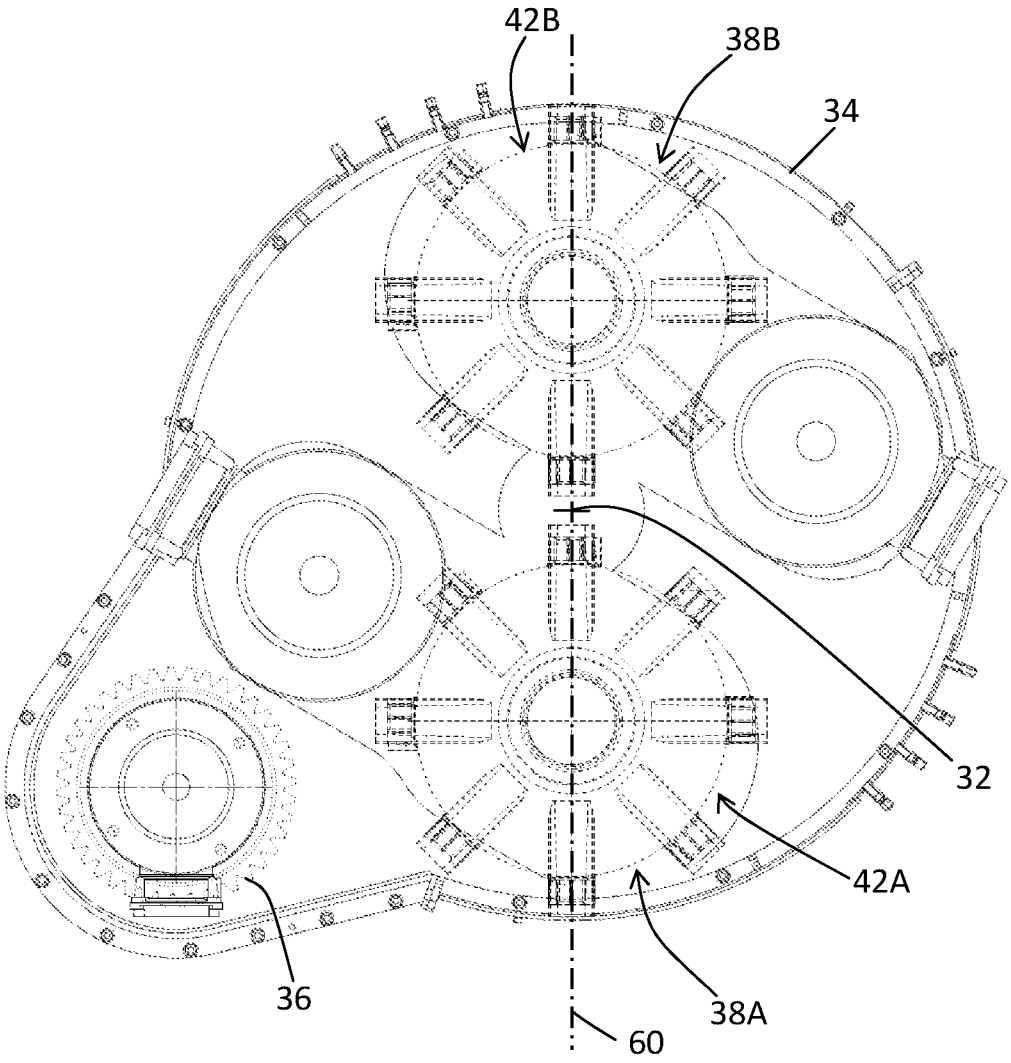
FIG. 3 shows a top plan view of the spindle-carrying structure according to FIG. 1.

Each spindle-carrying structure 34 is provided with a motor 36 (see FIG. 3) which causes the spindle-carrying structure 34 to rotate about the vertical axis 32.

Each spindle-carrying structure 34 is provided with two motorized spindles 38A, 38B, with vertical axes 40A, 40B, intended to support smoothing or polishing heads.

The spindles are preferably arranged spaced apart by the same amount and opposite each other with respect to the rotation axis 32 of the spindle-carrying structure 34 and therefore positioned eccentrically with respect to the axis 32.

On the bottom end of each spindle 38A, 38B it is mounted a tool-holder support consisting of a machining head 42A, 42B provided with abrasive tools 44A, 44B with work surfaces directed towards the surface of the slab to be smoothed.

Figure 2:
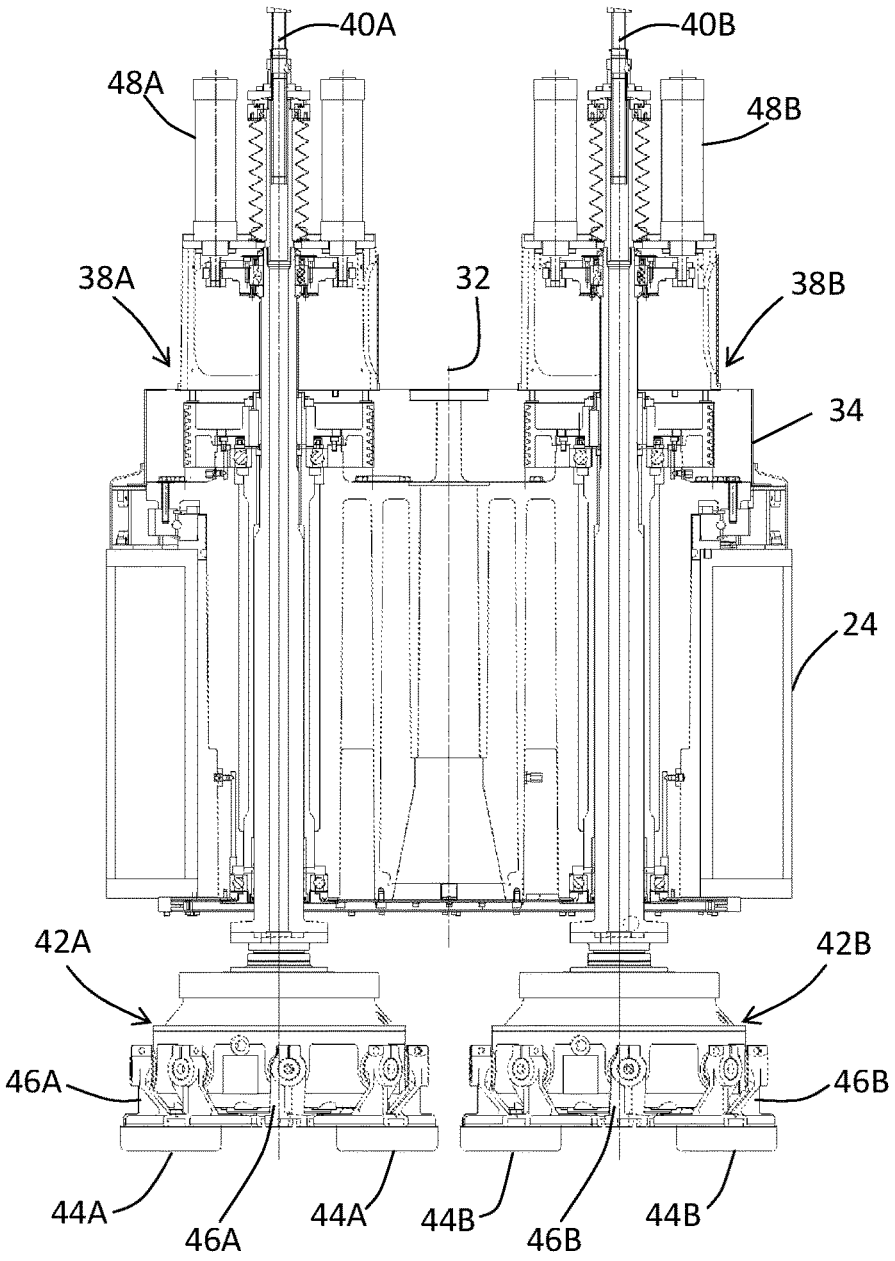
FIG. 2 shows a front view in schematic form of a spindle-carrying structure suitable for implementing the method according to the present invention.

The tool holders and the tools may have different configurations. In particular, in the embodiment shown in FIGS. 1-2, the tool-holder support consists of a smoothing head 42A, 42B, of the known oscillating shoe (or segment) type, rotating about the axis 40A, 40B of rotation of the spindle.

The smoothing head 42A, 42B with oscillating shoes is advantageously used for the smoothing and polishing of hard materials, such as granite or quartz, and comprises shoes 46A, 46B which are mounted radially and oscillating each about its own radial horizontal axis.

The shoes may be for example six in number and equidistant along a circumference centred on the spindle axis.

According to the present invention, the spindles 38A, 38B are preferably counter-rotating, namely they rotate with a direction of rotation opposite to each other.

Advantageously, the abrasive tools mounted on the smoothing heads of the same spindle-carrying structure 34 may have grain sizes which are the same or very similar, and the grain size of the tools may vary with a variation in the spindle-carrying structure on which they are mounted. In fact, in a preferred embodiment, the abrasive tools mounted on the spindle-carrying structure 34 which is the first to engage the material to be smoothed or polished have a relatively large grain size, while the spindle-carrying structures which follow in succession in the direction of feeding of the material use abrasive tools with an increasingly finer grain size.

In this way, the degree of finish of smoothing or polishing gradually increases as the slab of material passes underneath the various spindle-carrying structures 34.

Each spindle 38A, 38B is of the "plunger" type, i.e. movable vertically with respect to the spindle-carrying structure 34. The movement is imparted by actuators 48A, 48B which are advantageously pneumatic cylinders. It is thus possible to raise the smoothing head 42A, 42B so as to disengage it from the material to be machined or lower it so that the abrasive tools 44A, 44B are pressed against the slab with an adequate pressure for being able to smooth or polish the material.

The machine also comprises a computerized unit (not shown) for controlling the position, movement and speed of the moving members of the machine, said unit being programmable to as to manage the various movements of the machine components.

The movements which therefore can be controlled by the control unit comprise:

- a rotational movement of the tool about the vertical rotation axis 40A, 40B of the spindle 38A, 38B on which the smoothing head 42A, 42B is mounted;
- a revolving movement about the vertical rotation axis 32 of the spindle-carrying structure 34;
- an alternating translation movement in the transverse direction of the spindle-carrying beam 14;
- a longitudinal translation movement due to the advancing movement of the material placed on the belt; and
- the movement imparted by the machining head 42A, 42B to the tool 44A, 44B.

Speeds, for example, of between 5 and 60 rpm about the axes 32 for the machining units and 200-600 rpm for the spindles, and translation speeds of between 0.2 and 5 meters/minute for longitudinal displacement of the slab underneath the station, with a number of cycles (outward and return strokes) for the transverse movement, for example, of between 5 and 40 cycles per minute, have been found to be advantageous.

As mentioned above, the machining heads may also be equipped with tools different from those shown in the attached figures. In fact it is possible to provide in the case of soft materials such as marble an abrasive-carrying plate on which tools with a flat support surface are mounted. In the case of hard materials such as granite or quartz, a flat grinder head (also known as satellite head or orbital head), namely a head provided with flat grinder supports or holders rotating about a substantially vertical axis for flat abrasive tools, may be provided.

Another type of tool may comprise a roller smoothing head, namely a head provided with radial rotating supports with a substantially horizontal axis on which roller shaped tools are mounted.

In any case such a movement of a single abrasive tool allows the entire working area of the slab to be covered in a uniform and regular manner.

The method according to the present invention is characterized in that during operation:

- the beam and the spindle-carrying structures move coordinated and synchronized with each other;
- for each stroke of the beam 24 in the transverse direction, the spindle-carrying structure performs a rotation of 180° about its axis of rotation 32;
- when the beam 24 is located at the centre line of the bench 16, the axis 60 passing through the rotation axes of the spindles 38A, 38B is perpendicular to the longitudinal direction of the machine; and
- when the beam is located at the maximum distance from the centre line of the bench 16, the axis 60 is parallel to the longitudinal axis of the machine.

With reference to the movements described above, these are performed in relation to the bench 16, it being obviously understood that their magnitude depends on the dimensions of the slabs which are being machined.

At the point where the travel movement of the beam 24 is reversed, the speed of the same is zero. However, the spindle-carrying structure 34 continues its rotation, so that one of the smoothing heads 42A, 42B continues to advance and protrudes partially from the edge of the slab being machined.

The extent of this protrusion must however be limited, in order to prevent seizing of the tool along the edge of said slab. Normally the protrusion is such that the tool rests on the slab over about ⅔rds of its dimension (normally about 10-20 cm).

Figure 4:
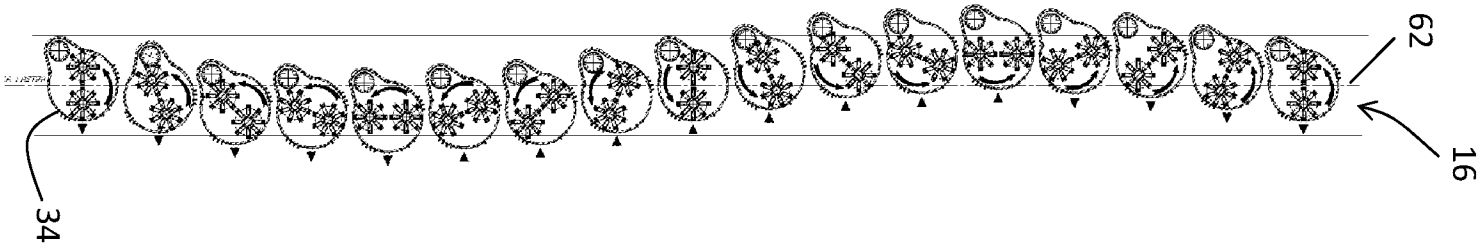
FIG. 4 and FIG. 5 show in schematic form a top plan view of a sequence of the possible positions assumed by a spindle-carrying structure during machining according to the method of the present invention.
Figure 5:
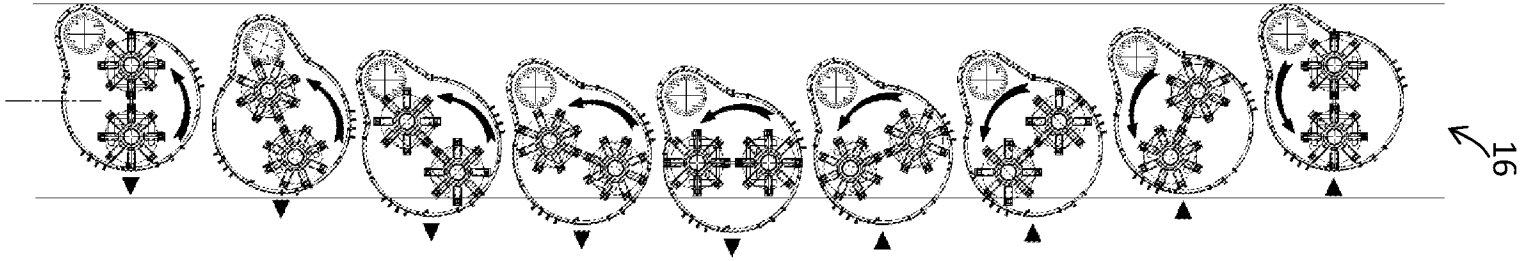

FIGS. 4 and 5 show, in simplified form and for the object described, the displacement performed by a spindle-carrying structure 34 according to the present invention with respect to the bench 16. The relative displacement in the longitudinal direction of spindle-carrying support and bench has been deliberately accentuated so that the movement may be readily understood.

As can be seen from FIG. 4, in the conventional starting position (lowest position), the spindle-carrying support 34 is arranged so that the axis 60 connecting the rotation axes of the spindles is perpendicular to the longitudinal direction, indicated in FIG. 4 by the reference number 62. Owing to the movement of the beam (not shown in the figure), the spindle-carrying support reaches the right-hand end position in which it is rotated by 90° with respect to the preceding position so that the axis 60 is parallel to the longitudinal direction 62 of the bench 16.

FIGS. 4 and 5 also illustrate the aforementioned protruding movement of the smoothing heads with respect to the edge of the slab being machined.

The movement of the beam continues so that the spindle-carrying support 34 moves towards the centre line of the bench 16, rotating by another 90° so that the axis 60 is again perpendicular to the longitudinal direction 62.

Figure 6:
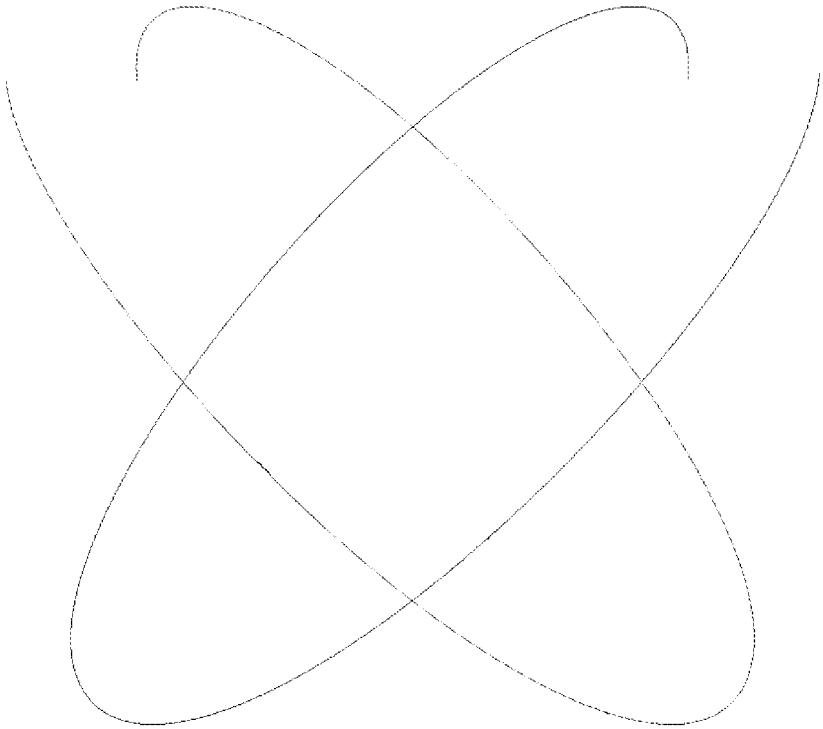
FIG. 6 shows a detail of the paths followed by the machining heads of a spindle-carrying structure during execution of the method according to the present invention.
Figure 7:
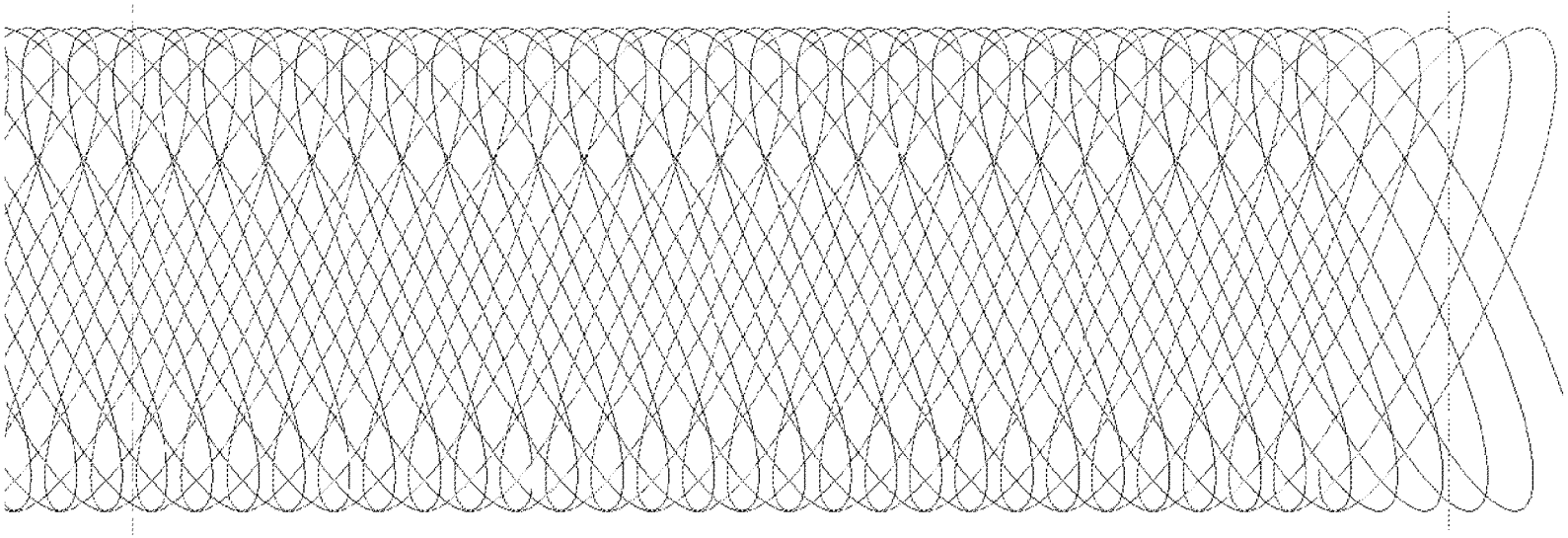
FIG. 7 shows the paths followed by the machining heads of a spindle-carrying structure during execution of the method according to the present invention.

FIGS. 6 and 7 show the paths of the centres of rotation of the machining heads 42A, 42B.

As can be seen in FIG. 6, the paths assume a substantially elliptical configuration, in which one of the ends is open, owing to the relative advancing movement of conveyor belt and machining head in the longitudinal direction and owing to the alternating movement of the beam in the transverse direction.

FIG. 6 shows instead the paths of the two heads for a single cycle, namely a forwards and backwards stroke of the spindle-carrying beam 24, while FIG. 7 shows the same relative longitudinal translation movement of machining heads and bench, which has not been amplified, but represents the real situation, in the case of a plurality of cycles, namely with a continuous movement.

As can be seen from the figure, all of the bench (and therefore the slab) is covered substantially in a very uniform manner, resulting therefore in particularly efficient machining.

The machine according to the present invention may comprise means for detecting the dimensions of the slab resting on the bench 16. By means of detection of the dimensions, the control unit may directly set both the limit values for the transverse movement of the beam and optionally the speed of relative advancing movement of slab and machining heads.

Advantageously the control unit is designed to set automatic limit values so as to condition reciprocally the movement of the beam, the rotation of the spindle-carrying support and the rotation of the machining heads.

Also provided are means for continuously detecting the position of the beam and the machining heads, said data being transferred to said control unit.

The advantages of the present invention compared to the prior art are therefore now clear.

In particular, to the naked eye the slab is seen as not having a varied polishing effect or machining marks, even when viewed against the light, and this therefore gives its a very special quality.

Obviously the description above of an embodiment applying the innovative principles of the present invention is provided by way of example of these innovative principles and must therefore not be regarded as limiting the scope of the rights claimed herein.

It is clear that functionally and conceptually equivalent variants and modifications fall within the scope of protection of the invention.

For example, the use of pneumatic actuators for the vertical movement of the spindles advantageously allows the machining pressure to be more easily adjusted and maintained. However, oil-hydraulic cylinders may be provided instead of pneumatic cylinders for movement of the spindles.

The invention claimed is:

1. Method for smoothing and/or polishing slabs of stone or stone-like material with a machine comprising:

- a support bench for a slab to be machined resting on a conveyor belt;
- at least one machining station comprising two bridge support structures transversally arranged astride the support bench, a spindle-carrying beam movable over the bridge support structures along a transverse direction relative to said bridge support structures;
- at least one spindle-carrying structure rotatable about a vertical axis thereof and provided on the spindle-carrying beam, each spindle-carrying structure provided with two motorized spindles having ends provided with polishing or smoothing heads spaced apart and opposite each other with respect to the vertical axis of the spindle-carrying structure and comprising abrasive tools;
- a programmable computerized unit for controlling the position, the movement and the speed of the spindle-carrying beam and each spindle-carrying structure;

wherein said method comprises steps of:

- moving the beam and each spindle-carrying structure in coordinated and synchronized fashion with each other;
- performing a rotation of 180° of each spindle-carrying structure about the vertical axis thereof for each stroke of the beam in the transverse direction; and
- smoothing or polishing the slab with the abrasive tools;
- wherein when the beam is located at a center line of the bench, an axis connecting the vertical axis of each spindle-carrying structure is perpendicular to a longitudinal direction of the machine; and
- when the beam is located at a maximum distance from the center line of the bench, the connecting axis is parallel to a longitudinal axis of the machine.

2. Method according to claim 1, characterized in that the abrasive tools are moved as per a combination of:

- a rotational movement of the abrasive tools about vertical rotation axes of the spindles on which the polishing or smoothing heads are mounted;
- a revolving movement about the vertical axis of the spindle-carrying structure;

an alternating translation movement along the transverse direction of the spindle-carrying beam; and a longitudinal translation movement due to an advancing movement of the material placed on the bench;

wherein movement imparted to the abrasive tools is by the polishing or smoothing heads therefor.

3. Method according to claim 1, further comprising a step wherein detection means detect dimensions of the slab placed on the bench and, by means of a control unit, limits of movement of the beam in the transverse direction are automatically set.

4. Method according to claim 1, characterized in that, in a position where transverse movement of the beam is reversed, the abrasive tools of the polishing or smoothing heads partially protrude from one or more edges of the slab.

5. Method according to claim 1, characterized in that the abrasive tools comprise oscillating shoes or segments which are mounted on the polishing or smoothing heads.

6. Method according to claim 1, characterized in that the abrasive tools are each in a form of a flat grinder which are mounted on the polishing or smoothing heads.

7. Method according to claim 1, characterized in that the abrasive tools are each in a form of a roller which are mounted on the polishing or smoothing heads.

8. Method according to claim 1, characterized in that the polishing or smoothing heads are each composed of an abrasive-carrying plate on which tools with a flat bearing surface are applied.

9. Method according to claim 1, characterized in that speed of rotation of the spindle-carrying structures is comprised between 5 and 60 revolutions per minute.

10. Method according to claim 1, characterized in that speed of rotation of the spindles is comprised between 200 and 600 revolutions per minute.

11. Method according to claim 1, characterized in that speed of relative translation of the bench and the machining station in the longitudinal direction is comprised between 0.2 and 5 meters/minute.

12. Method according to claim 1, characterized in that the beam performs a number of movement cycles in the transverse direction ranging between 5 and 40 cycles per minute.

* * * * *